United States Patent [19]

Burdin

[11] 3,965,858

[45] June 29, 1976

[54] APPARATUS FOR APPLYING PLASTIC COATINGS TO SMALL BODIES

[75] Inventor: Jacques Antoine Burdin, Ecully (Rhone), France

[73] Assignee: Societe Anonyme dite ATO CHIMIE, Courbevoie, France

[22] Filed: Aug. 12, 1974

[21] Appl. No.: 496,586

Related U.S. Application Data

[62] Division of Ser. No. 381,439, July 23, 1973.

[30] Foreign Application Priority Data

July 26, 1972 France ..... 72.27618
May 30, 1973 France ..... 73.20470

[52] U.S. Cl. ..... 118/417; 118/425; 118/429; 427/185

[51] Int. Cl.[2] ..... B05C 3/08

[58] Field of Search ..... 117/21; 118/400, 423, 118/425, 429, 417, 309; 427/185, 213

[56] References Cited

UNITED STATES PATENTS

| | | | |
|---|---|---|---|
| 2,654,465 | 10/1953 | Sgriccia | 118/425 |
| 3,097,958 | 7/1963 | Morris | 118/309 |
| 3,117,064 | 1/1964 | Friedrich | 118/429 |
| 3,197,328 | 7/1965 | Jung et al. | 118/429 |
| 3,567,485 | 3/1971 | Lemelson | 117/21 |

*Primary Examiner*—Mervin Stein
*Assistant Examiner*—Douglas Salser
*Attorney, Agent, or Firm*—Karl F. Ross; Herbert Dubno

[57] ABSTRACT

Small workpieces to be coated with plastic material are preheated and dropped onto a fluidized bed of plastic powder subjected to compound vibratory motion which causes the powder and the workpieces to move along a helical ramp onto a screen overlying the point of entry, with some of the particles fusing onto the workpiece surfaces to form a film. The remainder of the powder, on reaching the screen, drops back onto the bed as the coated workpieces move on to a receptable. Fresh workpieces are deposited on the bed through one or more chutes traversing the screen; to prevent the rise of any particles through the chutes, a downward airflow is created therein.

10 Claims, 3 Drawing Figures

11
4
4b
12a
2
5
2
2
14
4a
12
13

6
2
3
8
7
5
3
9
14
4
4b
12
12a
4a
10

APPARATUS FOR APPLYING PLASTIC COATINGS TO SMALL BODIES

This is a division of application Ser. No. 381,439, filed 23 July 1973.

The present invention relates to an apparatus for applying a coating of plastic, i.e. of thermoplastic or thermosetting material, to small parts by heating these parts and then introducing them into a powder bath of fluidized plastic material.

French Pat. No. 69 11 677 of January 1971 describes a method of this type consisting in dropping the heated workpieces into the powder bath of fluidized plastics material and allowing them to descend by gravity, the powder which is in contact with the surface of the workpieces being transformed into a film or coating.

However, the application of a method of this type causes several difficulties, in particular as regards recovering the coated workpieces from the bottom of the bath without marring them. Moreover, when a workpiece has a concave surface located on its underside as it penetrates the powder bath, an air pocket is formed which opposes contact of the powder with the workpiece in this region. It is thus impossible to apply this method to workpieces of every shape.

The object of my present invention is to provide an improved apparatus for the coating of mobile workpieces of various shapes in a manner avoiding the aforestated drawbacks.

In accordance with my invention, a fluidized bed of plastic material is confined in a vessel forming a track therefor, the plastic material being propelled along this track from a loading point to an unloading point by vibrating means coupled with that vessel. Workpieces to be treated are delivered to the vessel, via heating means serving to raise their temperature to an elevated level at which plastic particles from the bed fuse onto their surfaces to form a film, by feed means terminating above the loading point whereby the heated workpieces are dropped onto the track for entrainment by the plastic material to the unloading point where nonadhering particles are removed therefrom by separating means such as a perforated support forming an extension of the track.

Advantageously, pursuant to another feature of my invention, the separated particles are returned to the fluidized bed directly from the unloading point. For this purpose the track is shaped as an ascending, generally helicoidal ramp reverting to a location above the loading point which is overlain by the perforated support. The feed means delivering the oncoming workpieces to the fluidized bed preferably includes one or more chutes traversing the perforated support.

The coating material may be of thermoplastic or thermosetting character, e.g. a polyamide (such as the one known as "polyamide 11") or an epoxy resin.

The propulsion of small articles along an ascending path by a compound vibratory motion, representing the resultant of several periodic oscillatory movements along three mutually orthogonal axes, is known per se.

The above and other features of my invention will be described in detail hereinafter with reference to the accompanying diagrammatic drawing in which.

Figure 1:
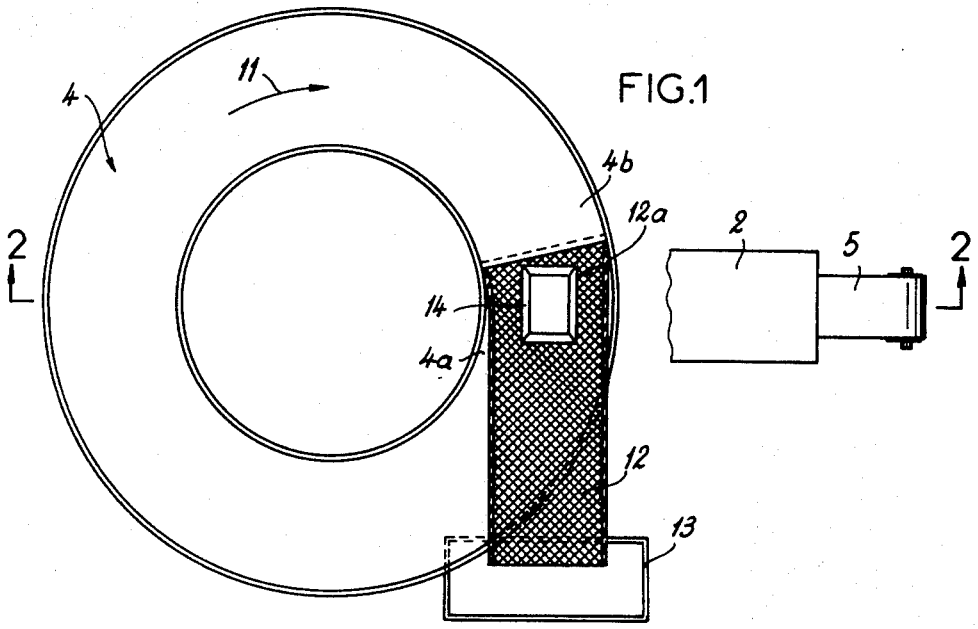
FIG. 1 is a top plan view of an apparatus according to my invention.

The apparatus shown in the drawing mainly comprises an oven 2 for pre-heating a series of small parts 3, representing the workpieces to be treated, and a vibrating container 4.

The oven 2 is a tunnel oven comprising an endless belt 5 driven at a constant adjustable speed in the direction of arrow 6 by the motor 7. This endless belt 5 conveys the parts 3 to be treated from the inlet aperture 8 of the oven 2 to an outlet aperture constituted by a vertical shaft 9 located below the downstream end of the belt 5. To facilitate loading of the parts 3 to be treated onto the belt 5, the upstream end of the latter is located outside the oven 2.

It should be noted that the temperature of the oven 2 is adjustable.

The container 4, filled with powdered plastic material, is constituted by a trough of semi-circular section substantially in the shape of a spiral having a vertical axis.

This trough 4 is mounted on a vibrating support 10 of known type, imparting vibrations thereto such that the powder which it contains moves at a constant speed, depending on the amplitude of the vibrations, in the direction of arrows 11. The lower end **4*a* of the trough 4 thus constitutes its inlet end and its upper end 4*b*** constitutes the outlet end thereof.

As shown in the drawing, the upper end **4*b* of the trough 4 is extended by a screen 12** whose mesh has a dimension greater than that of the grains of powder contained in the trough, but less than the minimum dimension of the parts to be treated.

This screen 12 is located partly above the end **4*a*** of the trough and partly beyond this end.

This arrangement serves to facilitate, on the one hand, re-cycling of the powder from the upper end **4*b* to the lower end 4*a* of the trough and, on the other hand, the separation of the treated parts 3 and the re-cycled powder, these treated parts being removed at the free end of the screen 12 in order to drop into a receptacle 13**.

Figure 2:
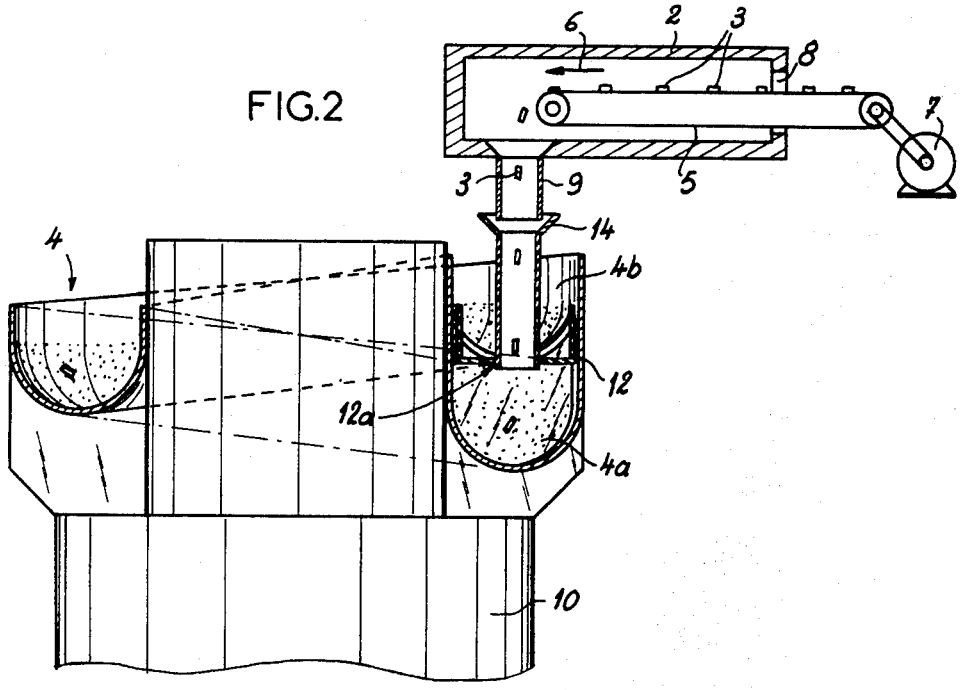
FIG. 2 is a sectional view taken on line 2—2 of FIG. 1.

As shown in FIG. 2, the lower end **4*a* of the trough is located below the shaft 9 constituting the outlet aperture of the oven 2. This arrangement is provided in order that the parts are introduced into the trough 4 in the region of the greatest turbulence of the comminuted plastic material i.e. in the zone in which this powder falls from the upper end 4*b* to the lower end 4*a* of the trough 4. Consequently, in order to facilitate the passage of the parts to be treated through the screen 12, the latter comprises an aperture 12*a* of dimensions corresponding substantially to those of the section of the shaft 9. However, in order to avoid that the treated parts 3 are also recycled when they arrive at the upper end 4*b* of the trough 4, this aperture 12*a* is provided on its periphery with a funnel shaped deflector 14 aligned with the lower end of the shaft 9**.

This apparatus operates as follows:

The parts to be treated are placed on the endless belt 5 of the oven 2 in order to be pre-heated. At the outlet of the oven 2, they fall directly through the shaft 9, the deflector 14 and the aperture **12*a* in the screen 12 into the trough 4 at its lower end 4*a*. The vibrations imparted to the trough 4 by its support 10 displace the plastic powder which it contains, and which is to form the coating for the treated parts 3**, from the lower end 4*a* to the upper end 4*b* from where it drops to the lower end 4*a* through the mesh of the screen 12. During its movement, the plastic powder carries along the preheated parts which are dropped into the trough 4 from the oven 2. As it is in contact with these parts, the powder forms a film whose thickness depends on the temperature of the parts and their thermal capacity as well as on the duration of travel of the parts 3 in the trough 4 and the nature of the plastic material. As it is formed, the film constitutes a thermal insulation whose outer surface is covered by superficial grains which have not melted and which may be easily removed at a later stage.

During their travel through the trough 4, the workpieces 3 are rolled in the plastic material powder and the rolling effect automatically moves them into the center of the vibrated bath. Contact between the workpieces and the powder is intimate and the stirring action is continuous whatever their shape. Moreover, it should be noted that the consistency of the powder is sufficient to support the weight of the workpieces and prevents the latter from coming into contact with the walls of the trough 4.

When the parts 3 arrive at the upper end 4*b* of the trough 4, whereas the powder drops to the lower end 4*a* through the mesh of the screen 12, the parts are retained by the latter and guided to its free end in order to be recovered in receptacle 13.

Figure 3:
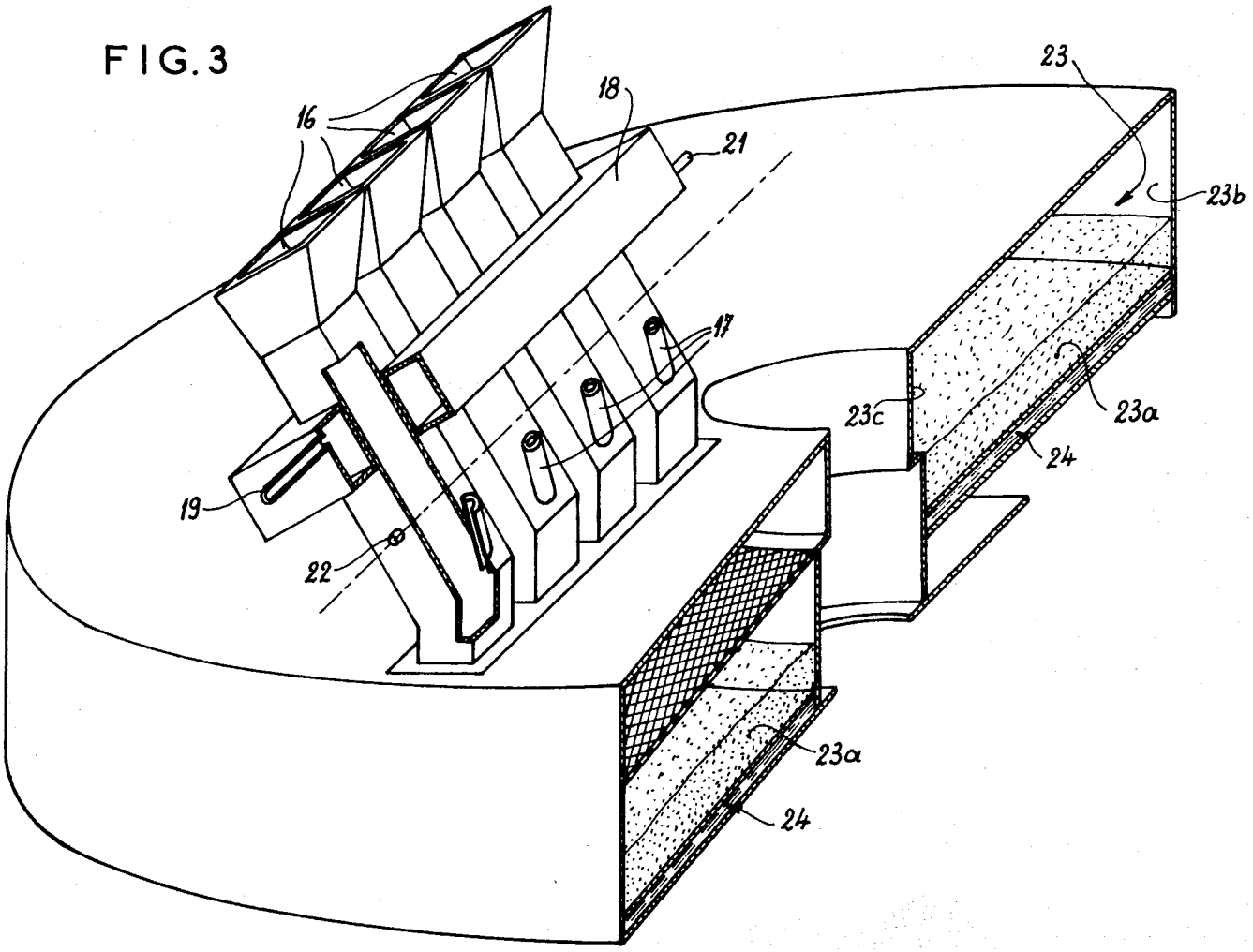
FIG. 3 is a perspective view partly in section showing various modifications of this apparatus on an enlarged scale.

FIG. 3 shows certain modifications of this apparatus.

In this example, the apparatus comprises a plurality (four in this instance) of chutes 16 intended to replace the deflector 14 of the apparatus described with reference to FIGS. 1 and 2.

The provision of several parallel chutes 16 has the advantage of facilitating transverse staggering of the parts to be treated on the conveyor belt of the oven (not shown on this view) so that successive parts on the feeding conveyor 5 do not use the same distribution chute.

Thus, owing to a good transverse distribution of the workpieces on the conveying belt of the oven, the danger is eliminated that a workpiece following too close to the preceding workpiece might come into contact with the latter as it falls into the powder bath.

Each of the chutes 16 comprises an inlet tube 17 for a downwardly directed current of air serving to prevent the treatment powder from moving up the chute in question.

The array of chutes 16 is surrounded by a box 18 serving for the circulation of cooling water and comprising, to this end, an inlet tube 19 for cold water and a water-outlet tube 21. This cooling water prevents melting of the powder which comes into contact with the chutes.

According to another feature of the invention, the array of chutes 16 is pivotable about a horizontal shaft 22 which makes it possible to vary their inclination. In this way I am able to modify the angle at which the parts fall into the powder bath and, consequently, their penetration into that bath. It is thus possible to obtain a constant depth of penetration while treating parts of different weights.

As further shown in FIG. 3, a vibrating container or bowl 23 containing the treatment powder has a U-shaped cross section comprising a flat base 23*a* and two vertical side walls 23*b* and 23*c*.

The rectangular shape of the section of the bowl has the advantage of preventing the formation of vortexes which would tend to retard the circulating speed of the powder bath and the treated parts and thus to increase the risk of contact between the parts below the distribution chutes.

Moreover, in order to prevent the walls of the vibrating bowl 23 from becoming heated, its base 23*a* has a double wall in order to provide a chamber 24 for the circulation of cooling water.

What I claim is:

1. An apparatus for coating mobile workpieces with plastic material, comprising:

a vessel of substantially rectangular cross-section having a flat bottom for confining a fluidized bed of plastic material, said vessel forming a track for said material extending between a loading point and an unloading point, said bottom forming a channel for the circulation of a cooling fluid;

vibrating means coupled with said vessel for propelling said material along said track from said loading point to said unloading point;

heating means adjacent said vessel;

feed means for delivering workpieces via said heating means to said vessel at an elevated temperature at which particles of said plastic material fuse onto the surfaces of said workpieces to form a film, said feed means terminating above said loading point whereby the heated workpieces are dropped onto said track for entrainment by said plastic material to said unloading point; and separating means at said unloading point for removing nonadhering particles from the coated workpieces.

2. An apparatus as defined in claim 1 wherein said separating means comprises a perforated stationary support forming an extension of said track.

3. An apparatus as defined in claim 2 wherein said track is an ascending ramp reverting to a location above said loading point, said perforated support overlying said loading point for returning the removed nonadhering particles to said fluidized bed.

4. An apparatus as defined in claim 3 wherein said feed means includes at least one chute traversing said perforated support.

5. An apparatus as defined in claim 4, further comprising conduit means extending from above into said chute for generating therein a descending airflow preventing the rise of any particles therein from said fluidized bed.

6. An apparatus for coating mobile workpieces with plastic material, comprising:

a vessel for confining a fluidized bed of plastic material, said vessel forming a track for said material extending between a loading point and an unloading point, said track including an ascending ramp terminating in a perforated stationary support overlying said loading point;

vibrating means coupled with said vessel for propelling said material along said track from said loading point to said unloading point;

heating means adjacent said vessel; and feed means including at least one chute traversing said perforated support for delivering workpieces via said heating means to said vessel at an elevated temperature at which particles of said plastic material fuse onto the surfaces of said workpieces to form a film, said chute terminating above said loading point whereby the heated workpieces are dropped onto said track for entrainment by said plastic material to said unloading point and return of nonadhering particles via said perforated support to said fluidized bed.

7. An apparatus as defined in claim 6, further comprising conduit means extending from above into said chute for generating therein a descending airflow preventing the rise of any particles therein from said fluidized bed.

8. An apparatus as defined in claim 6 wherein said chute is duplicated at a plurality of locations on a line transverse to said track.

9. An apparatus as defined in claim 6 wherein said chute is provided with pivotal mounting means for enabling an adjustment of its angle of inclination.

10. An apparatus as defined in claim 6 wherein said chute is provided with cooling means along its outer surface above said perforated support.

* * * * *